United States Patent [19]

Scanlon

[11] Patent Number: 4,920,854

[45] Date of Patent: May 1, 1990

[54] FLUIDIC NOISE SUPPRESSOR AND STABILIZER

[75] Inventor: Michael V. Scanlon, Springfield, Va.

[73] Assignee: The United States of America as represented by the Secretary of the Army, Washington, D.C.

[21] Appl. No.: 374,126

[22] Filed: Jun. 27, 1989

[51] Int. Cl.[5] ..... F41F 17/12

[52] U.S. Cl. ..... 89/14.4; 181/223

[58] Field of Search ..... 89/14.4; 181/223, 238, 181/270, 247; 137/835

[56] References Cited

U.S. PATENT DOCUMENTS

| | | | |
|---|---|---|---|
| 1,482,805 | 2/1924 | Maxim | 89/14.4 |
| 1,874,326 | 8/1932 | Mason | 89/14.4 |
| 2,043,731 | 6/1936 | Bourne | 89/14.4 |
| 3,158,166 | 11/1964 | Warren | 137/835 |
| 3,238,960 | 3/1966 | Hatch | 137/835 |
| 3,452,771 | 7/1969 | Kirshner et al. | 137/835 |
| 3,614,964 | 10/1971 | Chen | 137/835 |
| 3,667,570 | 6/1972 | WerBell | 89/14.4 |
| 3,952,629 | 4/1976 | Boccarossa et al. | 89/14.4 |
| 4,291,610 | 9/1981 | Waiser | 89/14.4 |
| 4,576,083 | 3/1986 | Seberger, Jr. | 89/14.4 |
| 4,588,043 | 5/1986 | Finn | 89/14.4 |
| 4,649,798 | 3/1987 | Phillips | 89/14.4 |

FOREIGN PATENT DOCUMENTS

| | | | |
|---|---|---|---|
| 63622 | 2/1914 | Austria | 89/14.4 |
| 338641 | 3/1936 | Italy | 181/223 |

*Primary Examiner*—Deborah L. Kyle
*Assistant Examiner*—Stephen Johnson
*Attorney, Agent, or Firm*—Saul Elbaum; Paul S. Clohan

[57] ABSTRACT

A noise suppressor and stabilizer for a firearm having a number of fluidic oscillator laminates each having a number of fluidic pressure controlled oscillators disposed thereon stacked and attached to the muzzle end of a firearm. The pressure controlled oscillators exhaust part of the propellant gases at a frequency either above the range of detection by the human ear or at a less sensitive region of hearing thus lowering the characteristic muzzle blast heard as the bullet exits the muzzle of the firearm. Additional laminates having the pressure controlled oscillators asymmetrically placed are provided to compensate for muzzle climb. Twist of the firearm is controlled by the placement of one or more twist compensating laminates within the stack. One embodiment of the invention provides for laminates of different internal dimensions forms expansion chambers within the noise suppressor.

9 Claims, 7 Drawing Sheets

F

FLUIDIC NOISE SUPPRESSOR AND STABILIZER

RIGHTS OF THE GOVERNMENT

The invention described herein may be manufactured, used and licensed by or for the United States Government for Governmental purposes without payment to me of any royalty thereon.

BACKGROUND OF THE INVENTION

The present invention relates to gun silencers, and more particularly to a silencer which uses fluidic oscillators to raise the frequency of part of the sound emitted from the muzzle of a gun barrel to a range that is not as sensitive or in some cases even detectable by the human ear.

The prior art is replete with gun silencer constructions which have as a primary purpose the lowering of the intensity of the sound caused by gun firing. One form of silencers includes a number of conical partitions which divide the interior of the silencer sleeve into many individual chambers. The performance of this type of silencer is reported to be less than satisfactory. Another form of silencer consists of a tubular casing which is mounted on the muzzle of the firearm. This silencer has a number of chambers therein, with the second chamber from the muzzle end of the silencer having a tube for the passage of the bullet through it and tapered openings in the partition between the first and second chambers to admit discharged gases into the second chamber. The third chamber from the muzzle end of this silencer consists of a number of conical partitions to divide this chamber into smaller individual chambers. Here again, the performance of this silencer is said to be less than satisfactory. A third type of silencer consists of a tubular casing with a few partitions which divide the interior of the silencer into a number of chambers with a passage provided for the bullet. The second chamber from the muzzle end of the silencer has a type of construction that separates discharged gases into a number of streams and then forces them to collide among themselves. The effectiveness of this type of silencer is somewhat limited. A fourth type of silencer uses an internal cardiod-shaped cavity which utilizes the principles of wave mechanics to attenuate the sound of a gun firing. The silencer cavity is shaped in a manner guiding and concentrating shock waves from a gun firing to an exit port at which sound-absorbing material is present.

None of the prior art utilizes the method provided by applicant's device which consists of modifying the acoustic signature of the weapon's blast so that it is undetectable or less sensitive to the human ear.

OBJECTS AND SUMMARY OF THE INVENTION

The primary object of the present invention is to increase the frequency of part of the sound emitted from the muzzle end of a firearm to a range that is not as sensitive or in some cases even detectable by the human ear.

A further object of the present invention is to reduce the effect of recoil, climb and twist of a weapon when it is fired.

A still further object of this invention is to reduce injury and fatigue to the shooter by reducing the noise and overpressure of the muzzle blast.

Another object of the present invention is to stabilize the weapon for better control and accuracy.

The current invention provides a noise suppressor that uses the bullet's propellant gases to supply a number of pressure controlled oscillators which will raise the frequency of the muzzle blast. The rising propellant gas pressure will cause the pressure controlled oscillator's to produce a high frequency sound that is either undetectable or in a less sensitive region of hearing to the human ear. This allows the propellant gas to "quietly" vent to atmosphere through the pressure controlled oscillators as the bullet passes through the noise suppressor. This gradual lowering of the propellant pressure will reduce the rapid expansion noise that occurs as the propellant gases leave the muzzle of the gun, thus reducing the characteristic muzzle blast heard when the bullet leaves the muzzle end of a gun. The noise suppressor is a cylindrical muzzle end device consisting of many thin annulus-shaped disks with the pressure controlled oscillators oriented radially around the disk's perimeter. By proper placement and design of the disks and pressure controlled oscillators, the noise suppressor will also provide control forces to reduce recoil, climb, and twist of the weapon when it is fired. The sound and pressure are exhausted radially from the noise suppressor, so that the effect on the shooter will be less than conventional muzzle brakes, which tend to deflect these back toward the shooter.

DETAILED DESCRIPTION OF THE PREFERRED EMBODIMENTS

Figure 1:
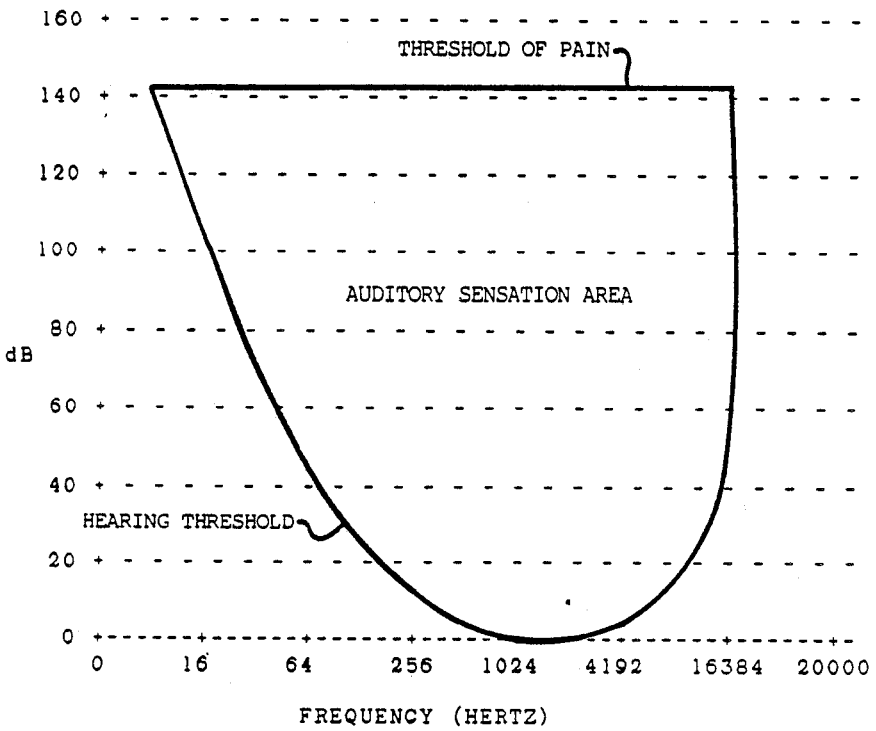
FIG. 1 represents graphically the area of hearing of a normal human adult.

The ear of an adult human can hear sounds at frequencies ranging from 15 hertz (oscillations or cycles per second) to 15,000 hertz, and children can hear sounds at frequencies up to 20,000 hertz. Sounds at frequencies lower than 15 hertz (infrasonic frequencies) and higher than 20,000 hertz (ultrasonic frequencies) also exist, although such frequencies are not audible to man. FIG. 1 depicts graphically the range of hearing of an adult human. The chart of FIG. 1 is obtained by plotting two curves: the audibility curve, which is the lower curve in FIG. 1, and the upper curve of "pain" or "feeling", which is usually known as the "threshold of pain" curve. The audibility curve is determined by measuring the hearing threshold for a series of frequencies within the hearing range. The hearing threshold for a given frequency is the lowest intensity at which that frequency can be heard. The upper limit of the auditory sensation area is determined by increasing the intensities of tones until they produce a perception of pain, tickle, or feeling. FIG. 1 shows that human individuals normally perceive as sound those frequencies between about 15 hertz and 15,000 hertz, with the greatest sensitivity around 1000–4000 hertz, i.e. the audibility curve, showing hearing thresholds for different frequencies, dips lowest for frequencies of around 1000–4000 hertz.

The intensity, or strength, of a sound is measured in two principal ways: in terms of the energy carried by the sound wave or of the alternating pressure changes produced as the sound wave passes by. As a practical matter, both measurements are usually converted into the decibel scale - a logarithmic scale with an arbitrary reference point, usually $2\times10^{-5}$ newtons per square meter. This arbitrary point is not far from the human threshold of hearing, and it is designated as 0 decibels or 0 dB.

An increase of 10 dB means a 10-fold increase in a sound's intensity; an increase of 20 dB, a 100-fold increase; and a 30-dB increase, a 1,000-fold increase in intensity. Ordinary conversation takes place at about 65 dB. Sounds become disagreeable to most people at about 100 dB, and sounds above 120 dB can produce a ticking or pricking sensation in the ears. Still more intense sounds cause pain and often a temporary loss of hearing.

Thus it can be seen from FIG. 1 that sounds above 15,000 hertz, no matter how high in intensity, will not be detected by the adult human ear. In other words, sound with a frequency of 5,000 hertz and an intensity of 120 dB is well within the auditory sensation area of the human ear; the same intensity of sound at a frequency over 15,000 hertz will not be detected by the adult human ear at all, and even if the intensity were raised as high as possible, it is physically impossible for the adult human ear to detect it. This then, is the principal behind the present invention. By converting the frequency content of a portion of the muzzle blast of a firearm to frequencies that are not as detectable to the human ear, part of the the muzzle blast is effectively silenced Referring now to FIGS. 2 and 2*a*, an oscillator laminate 10, made from any suitable steel, is shown. Smooth side 11 of laminate 10 is shown in FIG. 2*a*, which is a cross section along line 2*a*—2*a*. Opposite smooth side 11 is oscillator side 12 of oscillator laminate 10. Disposed on oscillator side 12 of oscillator laminate 10 are four pressure controlled oscillators 2 (shown enclosed within the dashed lines) which are machined or molded into laminate 10. The use of four pressure controlled oscillators is for the purpose of illustration only; more or less than four pressure controlled oscillators may be used depending upon the particular weapon involved. A typical oscillator, chosen for purposes of ease of explanation only, will comprise a main supply nozzle 6 extending through the end wall of an interaction region. Oscillator 12 is machined or molded to provide an end wall, two sidewalls (left and right sidewalls), and a divider disposed at a predetermined distance from the end wall. The sidewalls of the divider in conjunction with the interaction region sidewalls establish the receivers which are entrances to the oscillator's left output channel 4 and right output channel 7. Left and right control orifices extend through the left and right sidewalls respectively, and terminate in control nozzles which have their centerlines passing orthogonally through the centerline of the supply nozzle 6. Left feedback channel 3 and right feedback channel 5 connect the left and right oscillator output channels, respectively, to the left and right control nozzles. In the center of oscillator laminate 10 is a large aperture 8 extending through laminate 10 from smooth side 11 to oscillator side 12 (as shown in FIG. 2*a*) whose diameter is slightly larger than the inside diameter of the gun barrel upon which laminate 10 will later be mounted. The supply nozzle 6 of each pressure controlled oscillator 2 opens onto large aperture 8 and the left output channel 4 and right output channel 7 of each pressure controlled oscillator 2 exits to the atmosphere at the outer circumference of oscillator laminate 10. Four small apertures 14 are also provided, each one extending through laminate 10 from smooth side 11 to oscillator side 12 of oscillator laminate 10, as shown on FIG. 2*a*. Although many variations are possible, FIG. 2*b* shows one alternate embodiment of a pressure controlled oscillator. In this embodiment, pressure controlled oscillator 80 consists of a supply nozzle 82, a right feedback channel 86, a left feedback channel 88 and an output channel 84. The functioning of this pressure controlled oscillator is identical to the one described above.

Figure 2:
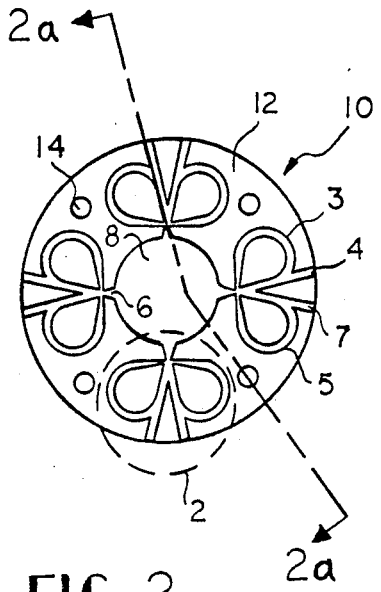
FIG. 2 is a front view of an oscillator laminate having four pressure controlled oscillators thereon.
Figure 2A:
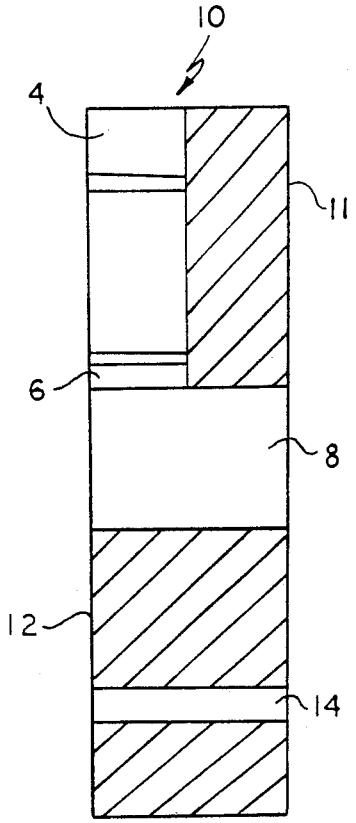
FIG. 2*a* is a cross section of the oscillator laminate of FIG. 2.
Figure 2B:
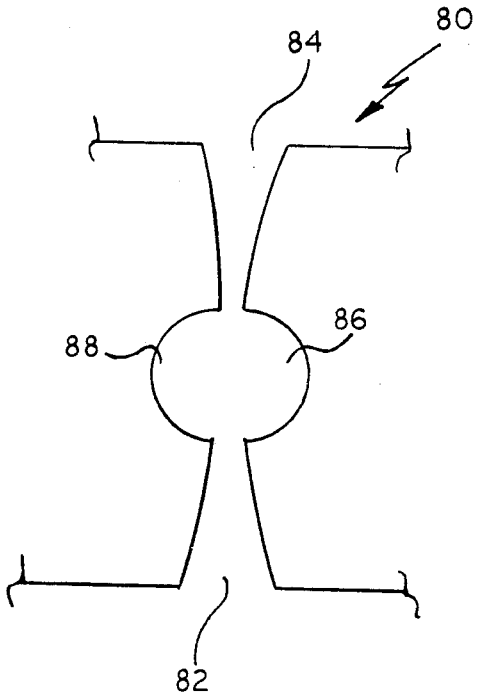
FIG. 2*b* is an alternate embodiment of a pressure controlled oscillator.
Figure 3:
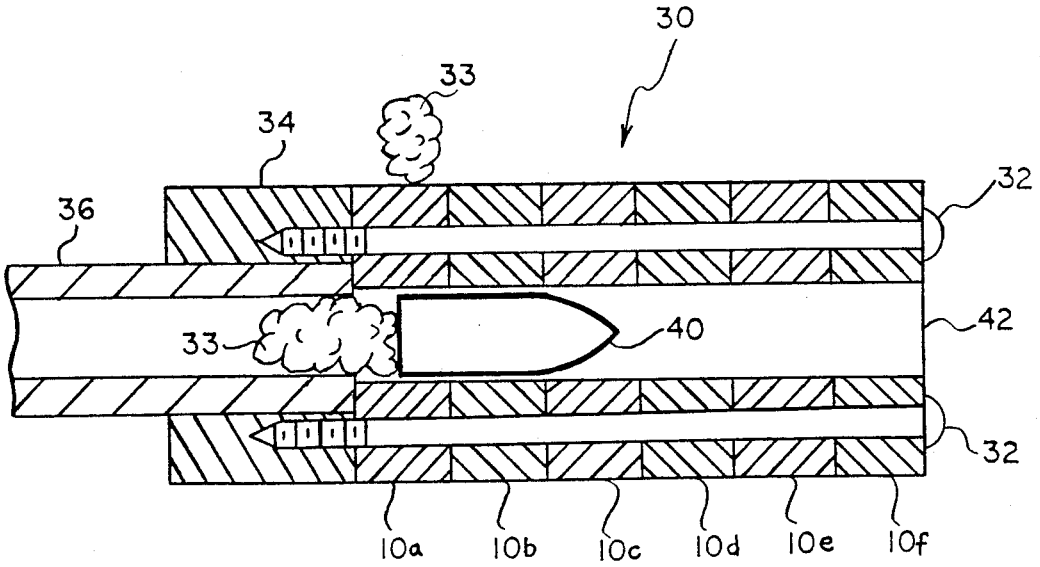
FIG. 3 is a cross section of a noise suppressor according to the present invention.

The construction of a noise suppressor using multiple oscillator laminates of the type shown in FIGS. 2 and 2*a* is shown in FIG. 3. A noise suppressor 30 is constructed by stacking any number of oscillator laminates (in this case six, shown as items 10*a*–10*f*). The use of six oscillator laminates is not mandatory but for illustration only. The number of oscillator laminates will depend upon the particular weapon involved. The oscillator laminates are arranged such that the oscillator side of each oscillator laminate faces the muzzle end of gun barrel 36 while the smooth side of each oscillator laminate faces away from muzzle end of gun barrel 36. This also means the oscillator side of oscillator laminate 10*f* faces the smooth side of oscillator laminate 10*e*, the oscillator side of oscillator laminate 10*e* faces the smooth side of oscillator laminate 10*d*, etc. This arrangement of oscillator side to smooth side of the oscillator laminates forms a "sandwich" of oscillator laminates and the smooth side of the oscillator laminate serves to restrict the fluid flow to an approximately two-dimensional flow pattern within the pressure controlled oscillator. The assembly of oscillator laminates 10*a*–10*f* are held together in this instance by four bolts 32, which extend through small aperture 14 (FIG. 2) of oscillator laminates 10*a*–10*f* and fasten by threads to receiving block 34, which is firmly attached to the muzzle end of gun barrel 36. The oscillator laminates could also be bonded together by any suitable bonding method.

As bullet 40 exits through noise suppressor 30, some of the bullet 40 propellant gas 33 is exhausted through the four pressure controlled oscillators in oscillator laminate 10*a* at a frequency above 15,000 hertz. In a similar manner, as bullet 40 passes oscillator laminate 10*b*, an additional amount of bullet 40 propellant gas 33 exhausts through laminate 10*b* pressure controlled oscillators. By the time bullet 40 exits noise suppressor 30 at end 42, most of the bullet 40 propellant gas has vented through the twenty four pressure controlled oscillators located in laminates 10*a*–10*f* and the characteristic muzzle blast, normally heard as bullet 40 leaves gun barrel 36, is significantly lowered.

A typical rifle produces anywhere from 12,000 psi (M-16) to 50,000 psi (.50 caliber) in gun barrel 36 when fired. The pressure at the exit point of a 7.62 mm NATO (.30 cal) bullet is 3,500 psi. This amount of propellant gas pressure is more than adequate to cause the pressure controlled oscillators in noise suppressor 30 to function as described above. The particular oscillator geometry can be varied to produce different frequencies if desired. The supply nozzle width, depth, feedback channel length, and supply nozzle to splitter distances all have an effect on the output frequency; design of these items is well known in the prior art. To prevent the oscillator from being saturated, the supply nozzle configuration can be designed to be a converging supply nozzle in order to choke the flow of the propellant gas in the supply nozzle thus limiting the propellant gas pressure going into the pressure controlled oscillator.

Figure 4:
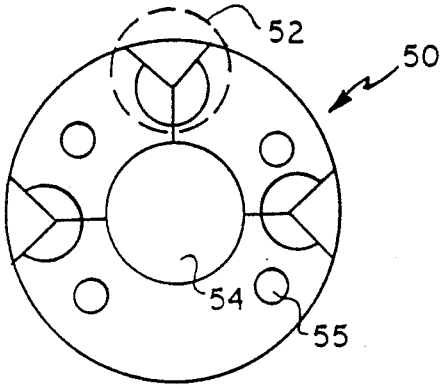
FIG. 4 is a front view of an alternate embodiment of an oscillator laminate.

By modifying the placement of the pressure controlled oscillators on the oscillator laminate, the noise suppressor can also function as a climb compensator. Shown in FIG. 4 is an oscillator laminate 50 in which three pressure controlled oscillators 52 (shown schematically) are placed asymmetrically around large aperture 54. Again, the use of three pressure controlled oscillators is for illustration only. Small apertures 55 serve the same function as those shown in FIG. 2. The release of propellant gas through pressure controlled oscillators 52 will result in a net force "F" on laminate 50 acting in the direction shown which can be used to compensate for the weapon's tendency to climb. In comparison, an oscillator laminate of the type shown in FIG. 2 has a net force of zero on laminate 10 because the pressure controlled oscillators are placed symmetrically around the large aperture. By stacking several laminates of the type shown in FIG. 4 into a noise suppressor of the type shown in FIG. 3 or FIG. 5 such that the sections without a pressure controlled oscillator align, the entire noise suppressor can be oriented in the proper direction to counteract the characteristic climb of any weapon.

Figure 5:
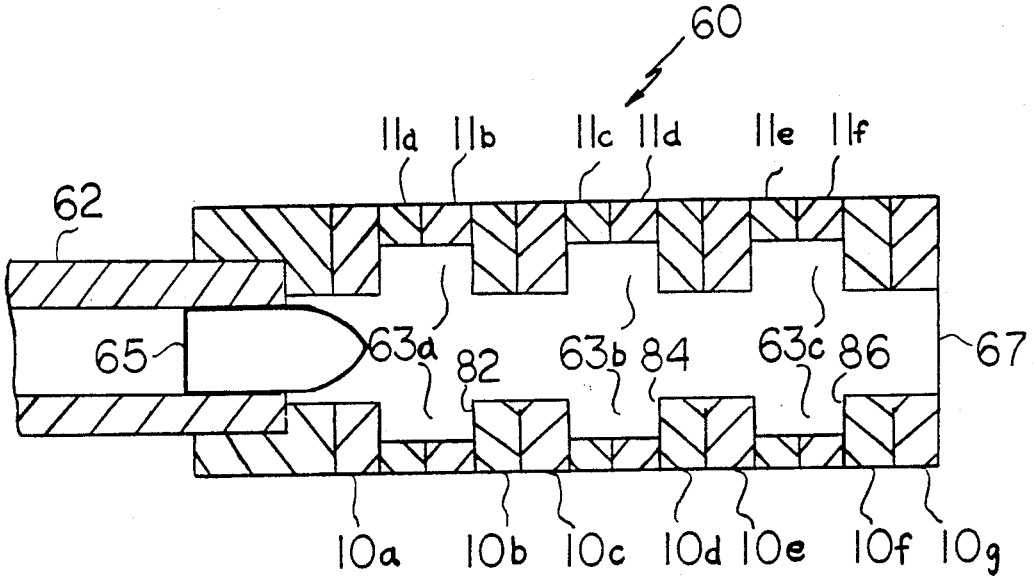
FIG. 5 is a cross section of an alternate embodiment of a noise suppressor according to the present invention.
Figure 6:
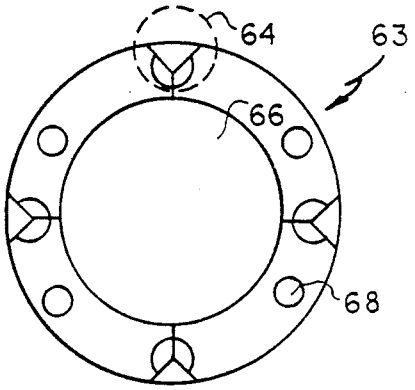
FIG. 6 is a front view of an alternate embodiment of an oscillator laminate.

Additional modifications to the basic noise suppressor design of FIG. 3 can add the feature of a muzzle brake. FIG. 5 shows a noise suppressor 60 mounted to gun barrel 62 having both noise suppression, anti-climb, and muzzle brake characteristics. A series of oscillator laminates 10*a*–10*g* constructed according to FIG. 2 and/or FIG. 4 is arranged as shown. Between these laminates is interposed oscillator laminates built according to FIG. 6. These laminates are designated 11*a*–11*f*. The use of seven oscillator laminates according to FIG. 2 and/or FIG. 4 and the use of six oscillator laminates according to FIG. 6 is for the purpose of illustration only. Any number of oscillator laminates may be stacked in this manner depending upon the characteristics of the particular weapon involved. In the oscillator laminate 63 of FIG. 6, four pressure controlled oscillators 64 (shown schematically) are located around large aperture 66 which is considerably larger than the large aperture of FIGS. 2 and 4. Again, the use of four pressure controlled oscillators is for illustration only. The four small apertures 68 are located in the proper position to align with the four small apertures 14 of FIG. 2 or the four small apertures 55 of FIG. 4. When the laminates of FIG. 2 and/or FIG. 4 and FIG. 6 are then stacked as shown in FIG. 5, a series of expansion chambers 63*a*–63*c* is provided in noise suppressor 60. As bullet 65 exits gun barrel 62, the bullet's propellant gas is forced to expand and contract as bullet 65 passes through noise suppressor 60; this expansion and contraction of the propellant gas tends to act as a muffler and slows down the expansion of the propellant gas as it leaves end 67 of noise suppressor 60. The expansion and contraction of the propellant gas also tends to increase and lengthen the duration of propellant gas pressure to the pressure controlled oscillators, therefore allowing more time for the propellant gas pressure to be bled off through the pressure controlled oscillators, which in turn would lower the amount of propellant gas that will rapidly expand at end 67. A further advantage of noise suppressor 60 is that it will tend to act as a muzzle brake and reduce recoil because when the pressure wave of the propellant gas moves forward and hits surface 82 of oscillator laminate 10*b*, surface 84 of oscillator laminate 10*d*, and surface 86 of oscillator laminate 10*f*, some of the energy of the pressure wave is used to force noise suppressor 60 to move forward, thus counteracting some of the weapon's recoil which tends to throw the weapon back into the shooter's shoulder.

Figure 7:
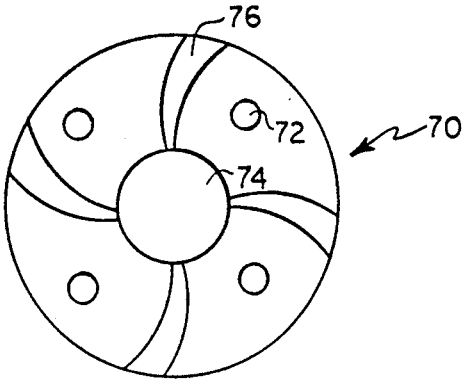
FIG. 7 is a front view of a twist compensating laminate.

A problem sometimes associated with the firing of a modern weapon is the twisting or torquing of the weapon as a result of the bullet traveling down the weapon's rifled gun barrel. The rifling groves inside the barrel are meant to impart a spin on the bullet so as to give the bullet stability in flight. The forces of the forward moving bullet acting on the rifling tend to twist the rifle. An additional item added to the basic noise suppressor design can effectively counteract this tendency for the weapon to twist. Using one or more twist compensating laminates 70 of the type shown in FIG. 7 will produce an axial torque opposite the twisting motion of the weapon. Four spiral channels 76 are machined or molded into laminate 70 in a manner similar to the creation of the pressure controlled oscillators. Again, the use of four spirial channels is for illustration only. Large aperture 74 is sized to the gun barrel and small apertures 72 are arranged to align with the small apertures of FIG. 2 and/or FIG. 4 and/or FIG. 6. The jets of propellant gas exiting spiral channels 76 will create a pure torque if symmetrically aligned around large aperture 74. The configuration of spiral channel 76 can also be adapted to each particular weapon. Twist compensating laminate 70 can be used in place of laminate 10*a* in FIG. 3 or FIG. 5, or placed wherever it is most beneficial to the weapon used on. More than one twist compensating laminate 70 can also be incorporated into any particular noise suppressor design.

All of the laminates described above exhaust the bullet propellant gasses perpendicular to the gun barrel, unlike some muzzle end devices which tend to redirect the bullet propellant gas as a pressure wave back toward the shooter, increasing fatigue due to blast overpressures and noise. The fluidic devices described above will significantly lessen these effects.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A noise suppressor for a firearm having a breech end, a muzzle end, and a bore comprising:

a plurality of fluidic oscillator laminates each comprising an annulus disk having a first surface, as second surface opposed to said first surface, a center, and an aperture having an axis, said aperture located at the center of said annulus disk, said first surface being smooth and said second surface having a plurality of fluidic pressure controlled oscillators disposed thereon;

said aperture having a diameter slightly greater than the diameter of the bore of said firearm;

said plurality of pressure controlled oscillators each having a supply nozzle opening upon said aperture of said annulus disk and at least one output channel open at the circumference of said annulus disk;

said plurality of fluidic oscillator laminates fixedly attached to one another forming a laminate stack such that said first surface of each said fluidic oscillator laminate is attached to said second surface of an adjacent said fluidic oscillator laminate;

said laminate stack fixedly attached to the muzzle end of said firearm such that the axis of said aperture of each said fluidic oscillator laminate is coaxially aligned with the bore of said firearm.

2. The device of claim 1 wherein at least one of said plurality of fluidic pressure controlled oscillators is configured so as to oscillate at a frequency above 15,000 hertz.

3. The device of claim 1 wherein said plurality of fluidic pressure controlled oscillators disposed upon said plurality of fluidic oscillator laminates are symmetrically arranged around said axis of said aperture.

4. The device of claim 1 wherein said plurality of fluidic pressure controlled oscillators disposed upon said plurality of fluidic oscillator laminates are asymmetrically arranged around said axis of said aperture.

5. The device of claim 1 further comprising at least one twist compensating laminate arranged within said laminate stack, said twist compensating laminate comprising an annulus disk having a first surface, a second surface opposed to said first surface, a center, and an aperture located at the center of said twist compensating laminate, said first surface of said twist compensating laminate being smooth and said second surface of said twist compensating laminate having a plurality of spiral channels disposed thereon.

6. A noise suppressor for a firearm having a breech end, a muzzle end, and a bore comprising:

a plurality of first fluidic oscillator laminates each comprising an annulus disk having a first surface, a second surface opposed to said first surface, a center, and an aperture having an axis, said aperture located t the center of said annulus disk, said first surface being smooth, said second surface having a plurality of fluidic pressure controlled oscillators disposed thereon and said aperture having a diameter slightly greater than the diameter of the bore of said firearm;

a plurality of second fluidic oscillator laminates each comprising an annulus disk having a first surface, a second surface opposed to said first surface, a center, and an aperture having an axis, said aperture located at the center of said annulus disk of said second fluidic oscillator laminate, said first surface of said annulus disk of said second fluidic oscillator laminate being smooth, said second surface of said annulus disk of said second fluidic oscillator laminate having a plurality of fluidic pressure controlled oscillators disposed thereon and said aperture of said annulus disk of said second fluidic oscillator laminate having a diameter greater than the diameter of said aperture of said first fluidic oscillator laminate;

said plurality of pressure controlled oscillators disposed upon said first fluidic oscillator laminates each having a supply nozzle opening upon said aperture of said annulus disk of said first fluidic oscillator laminates and a left and right output channel open at the circumference of said annulus disk of said first fluidic oscillator laminates;

said plurality of pressure controlled oscillators disposed upon said second fluidic oscillator laminates each having a supply nozzle opening upon said aperture of said annulus disk of said second fluidic oscillator laminates and a left and right output channel open at the circumference of said annulus disk of said second fluidic oscillator laminates;

said plurality of first and second fluidic oscillator laminates fixedly attached to one another forming a laminate stack having an alternating plurality of said first and second fluidic oscillator laminates thereby forming a plurality of expansion chambers within said laminate stack;

said laminate stack fixedly attached to the muzzle end of said firearm such that the axis of said aperture of each of said first fluidic oscillator laminate is coaxially aligned with the bore of said firearm and the axis of said aperture of each of said second fluid oscillator laminate is coaxially aligned with the bore of said firearm.

7. The device of claim 6 wherein said plurality of fluidic pressure controlled oscillators disposed upon said first fluidic oscillator laminate are symmetrically arranged around said axis of said aperture of said first fluidic oscillator laminates.

8. The device of claim 6 wherein said plurality of fluidic pressure controlled oscillators disposed upon said first fluidic oscillator laminate are asymmetrically arranged around said axis of said aperture of said first fluidic oscillator laminates.

9. The device of claim 6 further comprising at least one twist compensating laminate arranged within said laminate stack, said twist compensating laminate comprising an annulus disk having a first surface, a second surface opposed to said first surface, a center, and an aperture located at the center of said twist compensating laminate, said first surface of said twist compensating laminate being smooth and said second surface of said twist compensating laminate having a plurality of spiral channels disposed thereon.

* * * * *